US006279789B1

(12) United States Patent
Krall

(10) Patent No.: US 6,279,789 B1
(45) Date of Patent: Aug. 28, 2001

(54) CONTAINER AND CLOSURE PACKAGE AND METHOD OF FILLING

(75) Inventor: Thomas J. Krall, Toledo, OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 09/468,576

(22) Filed: Dec. 21, 1999

(51) Int. Cl.[7] ..... B65D 4/12

(52) U.S. Cl. ..... 222/482; 222/111; 222/545; 220/254; 220/359.3; 220/359.4

(58) Field of Search ..... 215/232; 220/254, 220/359.1, 359.3, 359.4, 359.5; 222/545, 482, 111

(56) References Cited

U.S. PATENT DOCUMENTS

| | | | | |
|---|---|---|---|---|
| 1,773,311 | * | 8/1930 | Killen | 215/260 |
| 2,046,227 | * | 6/1936 | White | 215/262 |
| 2,416,900 | * | 3/1947 | Busby | 220/254 X |
| 2,819,812 | | 1/1958 | Freundorfer . | |
| 3,325,033 | | 6/1967 | Wheaton . | |
| 3,488,201 | | 1/1970 | Pizarro . | |
| 4,109,815 | * | 8/1978 | Collins, III | 215/232 |
| 4,240,242 | | 12/1980 | Sullivan et al. . | |
| 4,586,622 | * | 5/1986 | Walldorf | 220/254 X |
| 4,700,857 | | 10/1987 | Kittscher . | |
| 4,926,613 | | 5/1990 | Hansen . | |
| 5,240,131 | | 8/1993 | Keller . | |
| 5,255,492 | | 10/1993 | Larson . | |
| 5,660,290 | | 8/1997 | Hayes . | |

* cited by examiner

*Primary Examiner*—Kenneth Bomberg

(57) ABSTRACT

A container and closure package that includes a container having a body with a finish surrounding a fill/dispensing opening, and a thread on the finish for removably securing a closure. A closure has a peripheral skirt with a thread for removably securing the closure to the container finish, and a base wall with a fill opening aligned with the fill/dispensing opening in the container when the closure is secured to the container. A cap is secured to the closure base wall closing the fill opening. In accordance with the preferred method for filling the package, the container and closure are provided to the packager as an assembled unit. The container is filled with product through the fill opening in the closure and the fill/dispensing opening in the container. The cap is then secured to the closure base wall over the fill opening to close and seal the package.

15 Claims, 2 Drawing Sheets

CONTAINER AND CLOSURE PACKAGE AND METHOD OF FILLING

The present invention is directed to product containment and dispensing packages, particularly liquid product containment and dispensing packages, and to a method of filling the package with product and then closing the package after filling.

BACKGROUND AND SUMMARY OF THE INVENTION

U.S. Pat. Nos. 4,917,269, 5,207,356 and 5,941,422 disclose product containment and dispensing packages, particularly liquid product containment and dispensing packages, that include a container surrounding a fill/dispensing opening, and a closure threadably received on the container finish closing the package. In the manufacture and filling of packages of this type, the containers and closures are typically shipped separately to the product packager, perhaps by different suppliers. The containers are filled with product by the packager in an automated or manual filling operation, and the closures are then applied to the container, again either automatically or manually, to complete the package. Alternatively, the closures may be applied to the containers when the containers and closures are supplied to the packager. This alternative reduces inventory at the packager, but requires the extra step of removing the closure prior to filling the container, followed by reapplication of the closure after filling.

A general object of the present invention is to provide a container and closure package, and a method of filling such a package, that reduce costs associated with handling and filling of the containers at the packaging facility by providing a container and closure package that can be filled and closed at increased speed, using less equipment and less labor. Another object of the invention is to provide a container and closure package that can be filled while reducing or eliminating leakage of product around the container finish and finish thread area. A further object of the invention is to provide a container and closure package that accommodates addition of promotional information or the like on the container package without requiring retooling of the container or closure. Yet another object of the invention is to provide a method of filling a container and closure package that achieves one or more of the objectives set forth immediately above.

A container and closure package in accordance with one aspect of the present invention includes a container having a body with a finish surrounding a fill/dispensing opening, and a thread or bead on the finish for removably securing a closure. A closure has a peripheral skirt with a thread or bead for removably securing the closure to the container finish, and a base wall with a fill opening aligned with the fill/dispensing opening in the container when the closure is secured to the container. A cap is secured to the closure base wall closing the fill opening. In accordance with the preferred method for filling the package, the container and closure are provided to the packager as an assembled unit. The container is filled with product through the fill opening in the closure and the fill/dispensing opening in the container. The cap is then secured to the closure base wall over the fill opening to close and seal the package.

In the preferred embodiments of the invention, the closure base wall has a recessed shoulder surrounding the fill opening in the closure, and the cap comprises a disk secured to the base wall against the recessed shoulder. The base wall of the closure preferably is flat, and the outer surface of the disk is preferably flush with the outer surface of the base wall. The underside of the disk may be metalized to facilitate induction or conduction welding the disk to the closure base wall, or the disk may be non-removably adhered to the closure base wall by other means. The disk may contain advertising or promotional information visible to a user. This advertising or promotional information may be readily changed by merely retooling manufacture of the disk, while the basic structure of the closure and container remain the same.

In the disclosed embodiments of the invention, the container preferably comprises a drainback-type container that includes a pour spout extending from the fill/dispensing opening of the container. This pour spout may be formed either integrally with the container body, or as part of a separate filament secured to the container body at the fill/dispensing opening. A thread on the container finish for securing the closure may be formed either integrally with the container body, or on a separate fitment secured to the finish of the container body.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
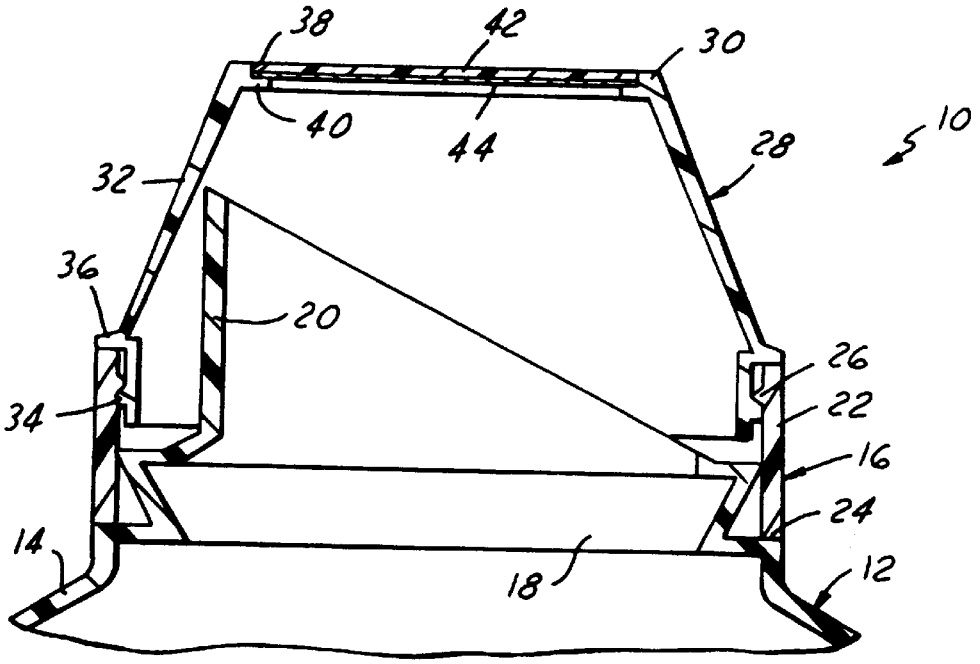
FIG. 1 is a fragmentary sectional view diametrically bisecting a container and closure package in accordance with one presently preferred embodiment of the invention.

FIG. 1 illustrates a package 10 in accordance with one presently preferred embodiment of the invention as comprising a container 12 having a body 14 from which a finish 16 extends surrounding and defining a central container fill/dispensing opening 18. Finish 16 includes a pour spout 20 integrally molded with container body 14, such as in an extrusion blow molding operation. Finish 16 also includes a collar 22 externally secured to the container against a shoulder 24 surrounding spout 20 and fill/dispensing opening 18. Collar 22 has one or more internal threads 26 for receiving and removably securing a closure 28 over fill/dispensing opening 18 of container 12.

Closure 28 includes a base wall 30 and a peripheral skirt 32 with an external thread 34 for removable engagement with internal thread 26 on collar 22. In the embodiment illustrated in FIG. 1, peripheral skirt 32 also includes a radially outwardly extending flange 36 for sealing engagement with the axial edge of collar 22. A fill opening 38 is centrally disposed in base wall 30 of closure 28 for alignment in assembly with fill/dispensing opening 18 of container 12. Fill opening 38 in closure base wall 30 is surrounded by an inwardly recessed ledge 40 that is disposed in a plane parallel to but offset from the planar top surface of closure base wall 30. A cap 42 is received within opening 38 against ledge 40. Cap 42 preferably comprises a flat plastic disk of uniform thickness having a metalized layer 44 on its undersurface. The periphery of disk 42 preferably is sealingly secured to closure base wall 30 by induction or conduction heating and welding, or other suitable means.

Container 12 in FIG. 1 may be formed of suitable plastic material in an extrusion blow molding operation as described. See, for example, U.S. Pat. Nos. 4,523,904 and 5,851,479. Collar 22 is preferably of plastic composition, as are closure 28 and disk 42. Closure 28 may be made in a suitable injection or compression molding operation.

Figure 2:
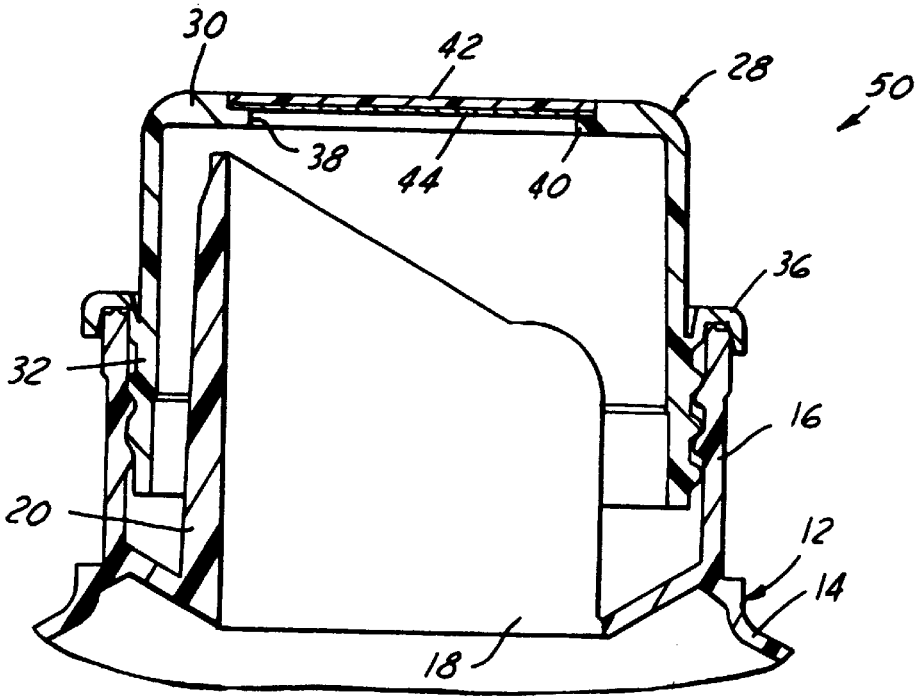
FIGS. 2 and 3 are fragmentary sectional views similar to that of FIG. 1 but illustrating respective modified embodiments of the invention.

FIG. 2 illustrates a modified embodiment 50, in which container body 14, container finish 16 and container pour spout 20 are formed as an integral unit, such as in an injection/extrusion blow molding operation in which finish 16 and pour spout 20 are injection molded, and container body 14 is then extrusion blow molded from the finish. See, for example, U.S. Pat. No. 5,114,659. Flange 36 on closure 28 is contoured to capture the axial edge of finish 16 for enhanced sealing engagement with the container finish. See U.S. application Ser. No. 09/082478 assigned to the assignee hereof and incorporated herein by reference. Closure 28 includes a disk 42 with metalized undersurface 44, as in FIG. 1, for induction or conduction sealing securement of the disk to the top wall of the closure.

Figure 3:
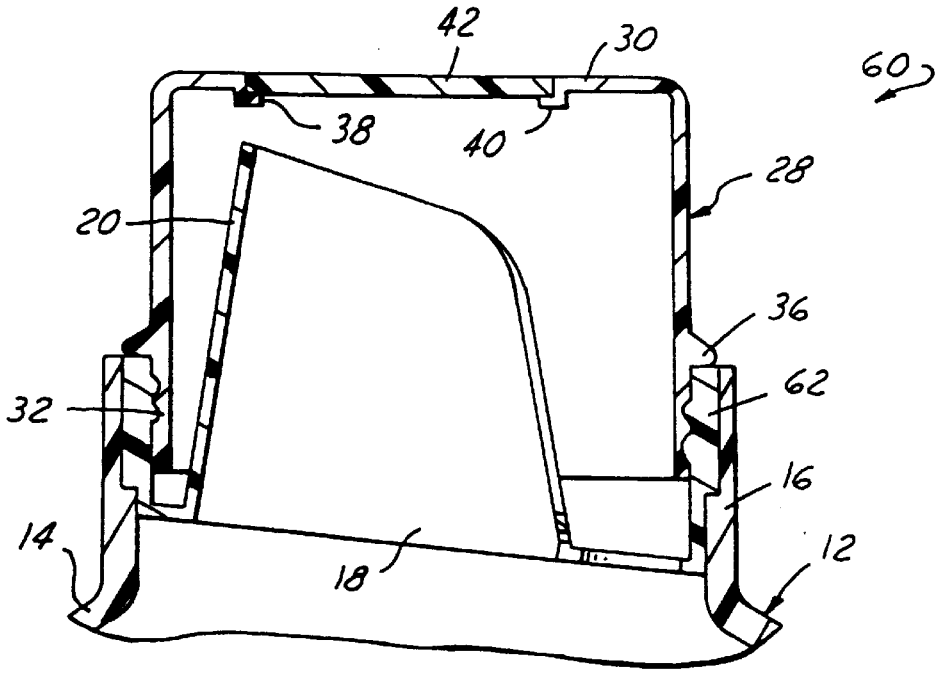

FIG. 3 illustrates an embodiment 60, in which pour spout 20 is formed as part of a fitment 62 that is secured within container finish 16. See U.S. application Ser. No. 09/015517 also assigned to the assignee hereof and incorporated herein by reference. Disk 42 in this embodiment does not have a metalized undersurface, and is secured by solvent or other suitable means of permanent adhesion. Otherwise, closure 28 is basically the same as in FIG. 1.

Figure 4:
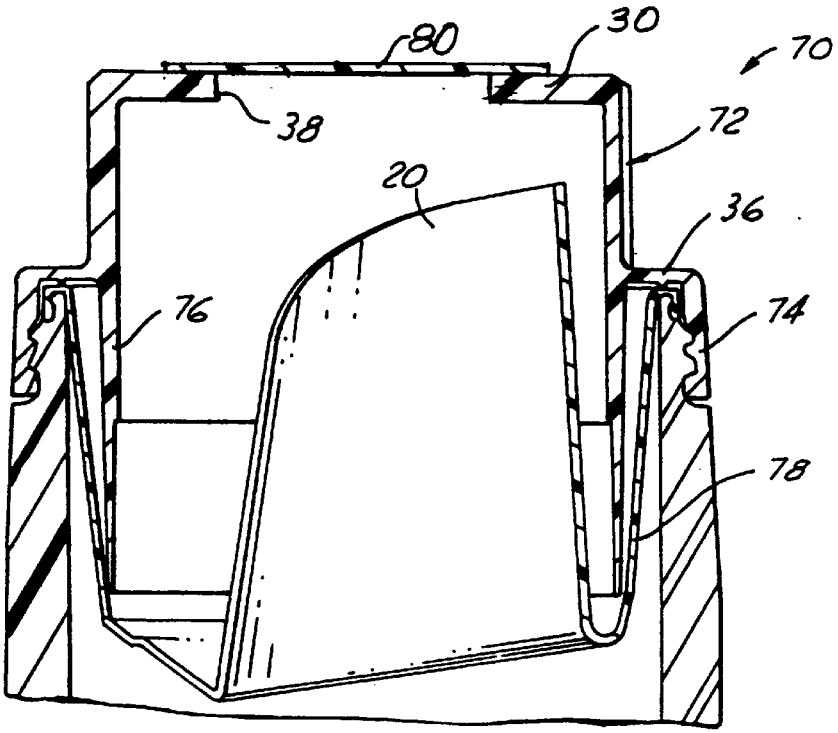
FIG. 4 is a sectional view similar to that of FIG. 1 but illustrating another embodiment of the invention.

FIG. 4 illustrates an embodiment 70 in which the closure 72 comprises a double-wall closure having an outside wall 74 for threading over the container finish and an inside wall 76 that forms the dosing cup. Spout 20 is carried by a fitment 78. Double wall closure 72 can also be used in conjunction with containers in which the spout is molded integrally with the container body, as in FIGS. 1 and 2. FIG. 4 also illustrates a modification in which disk 42 (FIGS. 1–3) is replaced by a cap in the form of a film 80 that is permanently secured, by adhesive or other suitable means, on the outside surface of closure base wall 30 over fill opening 38.

In each illustrated exemplary embodiment of the invention, the containers with finishes and pour spouts are formed in a generally conventional manner, as is the body of closure 28 or 72. Closure 28 or 72 (minus cap 42) is applied to the container and has a flange 36 or other suitable means for sealing engagement with the container finish. The container and closure subassembly can then be either bulk palletized or placed into cases, and shipped to a packaging customer for filling. The bulk palletized or cased containers are filled through the open top of the closure and through the fill/dispensing opening in the container. The closure cap, preferably in the form of a disk 42 or a film 80, is then applied over fill opening 38 in the closure, and non-removably welded or otherwise secured to closure base wall 30 for sealing the completed and filled package. There is no leakage of product on the thread of the container finish, which can adversely affect removal torque. The filling operation can be completed more quickly using less equipment and less labor as compared with conventional filling and capping techniques. The disk 42 can be readily reconfigured for promotional information, as previously discussed. The thickness of disk 42 preferably corresponds to the recessed or offset separation between ledge 40 and the top surface of closure base wall 30, so that the top surface of disk 42 is flush and coplanar with the top surface of base wall 30.

There have thus been disclosed a container and closure package, and a method of filling such a package, that fully achieve all of the objects and aims previously set forth. Several and modifications and variations have been disclosed. Other modifications and variations will readily suggest themselves to persons of ordinary skill in the art in view of the foregoing description. The invention is intended to embrace all such modifications and variations as fall within the spirit and broad scope of the appended claims.

What is claimed is:

1. A container and closure package that comprises:

a container having a body with a finish surrounding a fill/dispensing opening and means on said finish for removably securing a closure, a closure having a peripheral skirt with means for removably securing the closure to said finish, and a base wall with a flat outer surface and a fill opening aligned with said fill/dispensing opening in said container when said closure is secured to said container, said closure base wall having a recessed shoulder surrounding said fill opening, and a cap non-removably secured to said base wall over said fill opening closing and sealing the package, said cap comprising a flat disk on said recessed shoulder having an outer surface flush with said surface of said base wall and a metalized underlayer, and being welded to said recessed shoulder.

2. The package set forth in claim 1 wherein said container finish includes a pour spout extending from said fill/dispensing opening.

3. The package set forth in claim 2 wherein said pour spout is formed integrally with said container body.

4. The package set forth in claim 2 wherein said pour spout comprises a fitment secured to said container body at said fill/dispensing opening.

5. The package set forth in claim 2 wherein said means on said finish for securing the closure comprises a thread on said finish formed integrally with said container body.

6. The package set forth in claim 2 wherein said means on said finish for securing the closure comprises a thread on said finish is on a fitment secured to said finish.

7. A container and closure package that comprises:

a container having a body with a finish surrounding a fill/dispensing opening and means on said finish for removably securing a closure, a closure having a peripheral skirt with a thread for removably securing the closure to said finish, and a base wall with a fill opening aligned with said fill/dispensing opening in said container when said closure is secured to said container and a recessed shoulder surrounding said fill opening, and a cap for securement to said closure base wall closing said fill opening, said cap comprises a disk having a metalized underlayer and being induction welded to said recessed shoulder.

8. The package set forth in claim 7 wherein said base wall has a flat outer surface, and wherein said disk is flat and has an outer surface flush with said outer surface of said base wall.

9. The package set forth in claim 7 wherein said container finish includes a pour spout extending from said fill/dispensing opening.

10. The package set forth in claim 9, wherein said pour spout is formed integrally with said container body.

11. The package set forth in claim 9 wherein said pour spout comprises a fitment secured to said container body at said fill/dispensing opening.

12. The package set forth in claim 9 wherein said means on said finish for securing the closure comprises a thread on said finish formed integrally with said container body.

13. The package set forth in claim 9 wherein said means on said finish for securing the closure comprises a thread on said finish is on a fitment secured to said finish.

14. A closure assembly for securement to a container, which comprises:

a closure having a peripheral skirt with means for removably securing the closure to a container finish, and a base wall with a fill opening and a recessed shoulder surrounding said fill opening, and a cap for securement to said closure recessed shoulder closing said fill opening, said cap comprising a flat disk having a metalized underlayer for induction welding said disk to said recessed shoulder.

15. The closure assembly set forth in claim 14 wherein said closure base wall has an outer surface surrounding said opening, and wherein thickness of said disk is such that an outer surface of said disk is flush with said outer surface of said base wall when said disk is welded to said recessed shoulder.

* * * * *